US005927119A

United States Patent [19]

Hamano et al.

[11] Patent Number: 5,927,119

[45] Date of Patent: Jul. 27, 1999

[54] BULGE FORMING METHOD AND APPARATUS

[75] Inventors: Hidemitu Hamano, Kasakakemachi; Yutaka Mihara, Tokyo; Tetsuji Egawa, Okazaki; Takashi Suzumura, Toyota, all of Japan

[73] Assignee: Toyota Jidosha Kabushiki Kaisha, Toyota, Japan

[21] Appl. No.: 08/835,570

[22] Filed: Apr. 9, 1997

[30] Foreign Application Priority Data

Apr. 10, 1996 [JP] Japan ..... 8-088342

[51] Int. Cl.[6] ..... B21D 9/15

[52] U.S. Cl. ..... 72/58; 72/62

[58] Field of Search ..... 72/56, 58, 60, 72/62

[56] References Cited

U.S. PATENT DOCUMENTS

| | | | |
|---|---|---|---|
| 1,542,983 | 6/1925 | Bergmann, Jr. | 72/58 |
| 3,247,581 | 4/1966 | Pellizzari | 72/62 |
| 5,303,570 | 4/1994 | Kaiser | 72/62 |
| 5,481,892 | 1/1996 | Roper et al. | 72/62 |

FOREIGN PATENT DOCUMENTS

| | | | |
|---|---|---|---|
| 94 07 812 | 9/1994 | Germany . | |
| 43 22 711 | 1/1995 | Germany . | |
| 57-19114 | 2/1982 | Japan . | |
| 58-74221 | 5/1983 | Japan . | |
| 58-199626 | 11/1983 | Japan . | |
| 07155857 | 6/1995 | Japan . | |
| 633635 | 11/1978 | U.S.S.R. | 72/58 |
| 1449171 | 1/1989 | U.S.S.R. | 72/58 |
| 96/09949 | 4/1996 | WIPO . | |

*Primary Examiner*—David Jones
*Attorney, Agent, or Firm*—Burns, Doane, Swecker & Mathis, LLP

[57] ABSTRACT

According to a hydraulic bulge forming method, a bend pipe is inserted in a cavity, and when the bend pipe is subjected to bulge forming, the bend pipe is elastically deformed by supplying a pressure medium to an interior of the bend pipe so that an inside of the bent portion is bulged along a bulging region formed at a portion of the cavity corresponding to an inside of a bent portion of the bend pipe. Whereby a reduction in a wall thickness of the outside portion of the bent portion is suppressed, so that a danger of causing breaking can be prevented.

16 Claims, 6 Drawing Sheets

ONLY UPSETTING
(INTERNAL PRESSURE IS
SLIGHTLY APPLIED)

APPLICATION OF INTERNAL PRESSURE
+PIPE END PUSHING
(OUTSIDE BULGING)

BULGE FORMING METHOD AND APPARATUS

BACKGROUND OF THE INVENTION

The present invention relates to a method and an apparatus for subjecting a pipe member to bulging forming, and in particular, to bulge forming method and apparatus for carrying out bulge forming in the case where a raw member is a bend pipe.

Conventionally, some methods of forming a member as shown in FIG. 8, which has a different cross section in each portion and is bent as a whole such as a member for automobiles have been proposed. Japanese Patent Laid-open Publication (Kokai) No. 57-19114 discloses a method of manufacturing a member with an elbow. According to the method, a straight pipe is pressed so that the pipe is bent while applying an internal pressure thereto, and slightly subjecting the pipe to bulging process, thus forming an elbow of the pipe.

In order to form the member as described above, in general, processes as shown in FIG. 9 has been employed. Specifically, according to the processes, a straight pipe is subjected to bending, and then, the resultant pipe is pressed while being subjected to hydraulic bulge forming.

Japanese Patent Publication (Kokoku) No. 60-5126 discloses a method of manufacturing a branch pipe.

According to the method, a straight pipe with one bent portion is subjected to hydraulic bulge forming so that its center portion can be bulged, and an outside on the center of bulged bend pipe is subjected to burring, and subsequently, an opening having the same diameter as the original pipe is formed, thus a branch pipe being formed.

Further, Japanese Patent Publication (Kokai) No. 58-74221 proposes a technique of manufacturing a crankshaft. According to the technique, a U-shaped pipe having four bent portion with a large R is inserted in a die, and the pipe is subjected to hydraulic bulge forming so as to make sharp the R of the bent portion.

Furthermore, Japanese Patent Publication (Kokai) No. 58-199626 discloses a method in order to make small the R of an inside of the bend pipe. According to the method, a pipe is subjected to bending, and then, the pipe is subjected to hydraulic bulge forming after inserting the pipe into a die having an extremely small inside R. Whereby a bend pipe having a small curvature on its inside portion can be obtained.

Among the aforesaid conventional methods, according to a method of carrying out bending while applying an internal pressure; for example, the method disclosed in Japanese Patent Publication (Kokai) No. 58-19114, a principal purpose of applying the internal pressure is to prevent inward buckling caused in pressing. Therefore, this method does not positively carry out bulge forming, and is not suitable for forming a member as shown in FIG. 8, which must be partially bulged in cross section.

Except for Japanese Patent Publication (Kokai) No. 58-19114 which discloses the method of carrying out bending while applying an internal pressure, according to other techniques, a pipe is first subjected to bending by various forming methods, as shown in FIG. 9. At this point of time, a wall thickness of an outside portion of the member becomes considerably thin. FIG. 10 shows a wall thickness strain distribution on inside and outside portions of an electroseamed steel pipe (equivalent to STKM13B) when being subjected to rotary draw bending at an angle of 90°.

As seen from FIG. 10, the wall thickness of the inside portion becomes thicker than the initial one by bending. However, the wall thickness of the outside portion becomes 30% thinner than the initial one. For this reason, the steel pipe reaches the vicinity of forming limit by only bending. Therefore, it can be seen that there is a great danger of causing breaking. In addition, according to hydraulic bulge forming which is the next process, as shown in FIG. 11, the outside portion of the steel pipe is further bulged, and then, is subjected to upset forming. For this reason, the outside portion has a great danger of causing breaking more and more.

In particular, according to the technique disclosed in Japanese Patent Publication (Kokai) No. 58-74221, a cavity corresponding to the outside portion on a bent portion of the bend pipe is considerably large. For this reason, large bulge deformation is required. Moreover, in the case where the corner portion of the cavity is sharp, a wall thickness of a portion corresponding to the corner portion becomes extremely thin after forming. This results from the following reason. Specifically, when the pipe member comes into contact with the cavity, the member is suppressed from moving due to frictional effect, so that the wall thickness of the member is hard to be reduced. However, if the corner portion of the cavity is sharp, there is a considerable delay in timing when the member corresponding to the corner portion comes into contact with the cavity. For this reason, the wall thickness reduction speed does not become late.

Even if the corner R of bulging portion is small, for example, if a member is subjected to bulge forming such that it is bulged by the vicinity of breaking limit, or if a high strength member having low ductility is used, breaking is caused before the member is formed into the final product shape. As a result, a predetermined forming can not be carried out. Therefore, there is arisen a serious problem.

In order to solve the above problem, as seen from hydraulic bulge forming which is employed for manufacturing a T-shaped pipe of from a straight pipe, there has been proposed a technique in which a bulging allowable piston is arranged on a portion corresponding to the bulging, and the piston is retreated in accordance with the forming progress (see Japanese Patent Publication (Kokoku) No. 60-51209). However, according to the technique, the target member is limited to a straight pipe, and there is no reference to the matter that a pipe member is subjected to preforming such as bending, etc.

BRIEF SUMMARY OF THE INVENTION

An object of the present invention is to provide bulge forming method and apparatus which lessens a reduction in a wall thickness of an outside portion on a bent portion of a bend pipe which is thin in its wall thickness and has high danger of causing breaking, when carrying out bulge forming in a case where a raw member is bend pipe.

To solve the above problem, first, the present invention provides a bulge forming method comprising a step of inserting a bend pipe into a cavity in a die and a step of subjecting to bulge forming. The method is further characterized in that the cavity is formed with a bulging region at a portion corresponding to an inside on a bent portion of the bend pipe, and a pressure medium is supplied to an interior of the bend pipe inserted in the cavity, thereby the bend pipe being elastically deformed so that the inside on a bent portion of the bend pipe is bulged along the bulging region.

Second, the present invention provides a bulge forming apparatus comprising a die having a cavity for inserting a bend pipe, and a means for supplying a pressure medium to an interior of the bend pipe inserted in the cavity. Further, the apparatus is characterized in that the cavity is formed with a bulging region at a portion corresponding to an inside on a bent portion of the bend pipe, and a pressure medium is supplied to an interior of the bend pipe inserted in the cavity, thereby the bend pipe being elastically deformed so that the inside on a bent portion of the bend pipe is bulged along the bulging region.

Third, the present invention provides a bulge forming method comprising a step of inserting a bend pipe into a cavity in a die and a step of subjecting to bulge forming. The method is further characterized in that a movable support die for supporting an outside of a bent portion of the bend pipe is arranged, and is movable in a state of supporting the outside in accordance with deformation of the outside during bulge forming.

Fourthly, the present invention provides a bulge forming apparatus comprising a die having a cavity capable of inserting a bend pipe therein, and a means for supplying a pressure medium to an interior of said bend pipe inserted in said cavity to subject the bend pipe to subject the bend pipe to bulge forming by the pressure medium. Further, the apparatus further includes a movable support die which supports an outside of a bent portion of the bend pipe and an actuator means for moving the movable support die, and the support die is movable by means of the actuator means in a state of supporting the outside in accordance with deformation of the outside during bulge forming.

In order to obtain a bend pipe, according to bending, a phenomenon takes place such that a wall thickness of an outside portion of the bend pipe becomes thin; on the other hand, a wall thickness of an inside portion thereof becomes thick resulting from volume constancy law. Taking such a phenomenon into consideration, the present inventors have made to earnestly study for finding a condition that no breaking is caused in the outside portion on a bent portion of the bend pipe when using the bend pipe as a target member.

Specifically, according to one embodiment, bulge forming is positively carried out by taking advantage of a portion where a wall thickness becomes thicker. More specifically, the cavity, in which a bend pipe is inserted, is formed with a bulging region at a portion corresponding to an inside on the bend portion of the bend pipe, and bulge forming is carried out so that the inside portion having a thicker wall thickness can be bulged along the bulging region. Whereby the outside portion on the bent portion can be prevented from becoming thin.

Moreover, according to another embodiment, in the case where there is a need of forming a bend pipe so that an outside portion on the bend portion of the bend pipe is bulged in its design, a movable support die supports the outside portion on the bent portion of the bend pipe where breaking is easy to be caused, preferably, a portion where it is easy to cause breaking most. And then, during bulge forming, the movable support die is moved in a state of always supporting the bend pipe in accordance with the deformation of the bend pipe. Whereby bulge forming of the bend pipe is carried out so that the outside portion on the bent portion of the bend pipe, where breaking is easy to be caused, can be suppressed from being reduced in its wall thickness.

Also, the bulge forming method of the present invention is effective in a case where composite bulge forming is carried out together with other forming methods such as upsetting as well as a case where the bulge forming is singly carried out.

According to the present invention, in the case where a bend pipe which is formed by bending, etc., is subjected to bulge forming, bulge forming is positively carried out with respect to a great forming redundant portion formed by the initial secondary processing when forming a bend pipe, that is, an inside portion on the bend portion of the bend pipe. Moreover, in the case where there is a need of bulging a portion, which is thin in its wall thickness, that is, an outside portion on the bent portion of the bend pipe, bulge forming is carried out while the outside portion being always supported by means of a movable support die. Thus, it is possible to suppress the outside portion on the bend portion of the bend pipe, which is thin in its wall thickness, from being excessively reduced. This serves to remarkably make long a circumferential length on the maximum bulging portion, as compared with a conventional bulge forming product. Accordingly, in the present invention, composite bulge forming is carried out in combination of bulge forming and other forming such as upset forming, so that a member having a complicated shape can be formed, and freedom of design when forming a pipe member can be also greatly improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described below in detail.

Figure 1A:
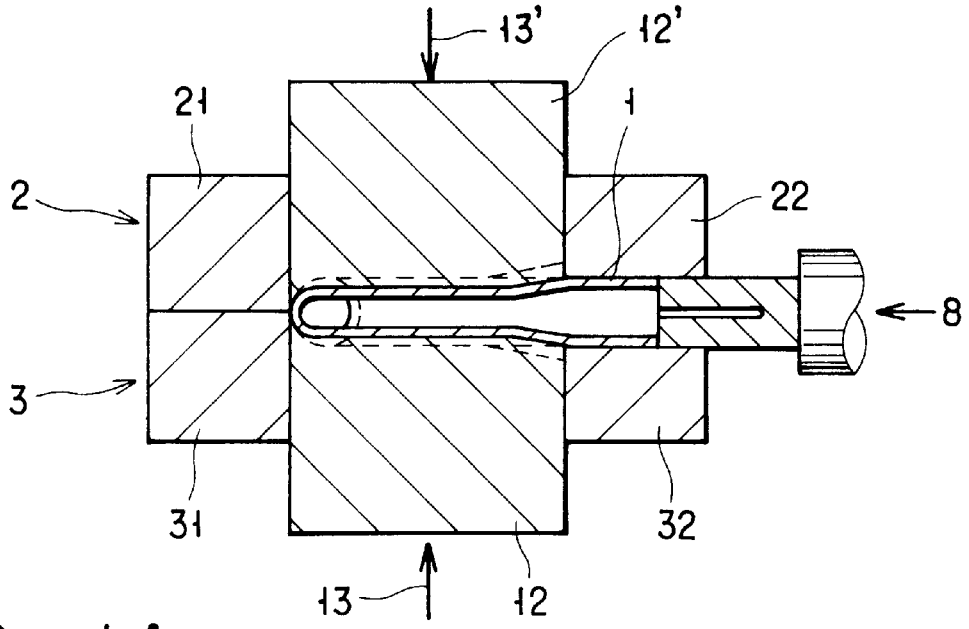
FIG. 1A is a vertical sectional view of an apparatus for carrying out a bulge forming method according to one embodiment of the present invention.

FIG. 1 shows an apparatus for carrying out a bulge forming method according to one embodiment of the present invention. The apparatus has an upper die 2 which is capable of being divided into two parts 21 and 22, and a lower die 3 which is capable of being divided into two parts 31 and 32. A cavity 20 is formed in a state that these upper and lower dies 2 and 3 are combined. A bend pipe 1 which is previously subjected to bending is set in the cavity 20 as a raw member.

Also, the upper and lower die 2 and 3 are provided with punches 12 and 12' for pressing the bend pipe 1 in the cavity 20 upward and downward, respectively. These punches are fitted in the dies so that they are movable in a vertical direction. Further, these punches 12 and 12' are each connected with an upsetting cylinder (not shown). When the punches 12 and 12' are moved by means of the cylinder, a press load 13, 13' is applied to the bend pipe 1 in the cavity 20.

Figure 1B:
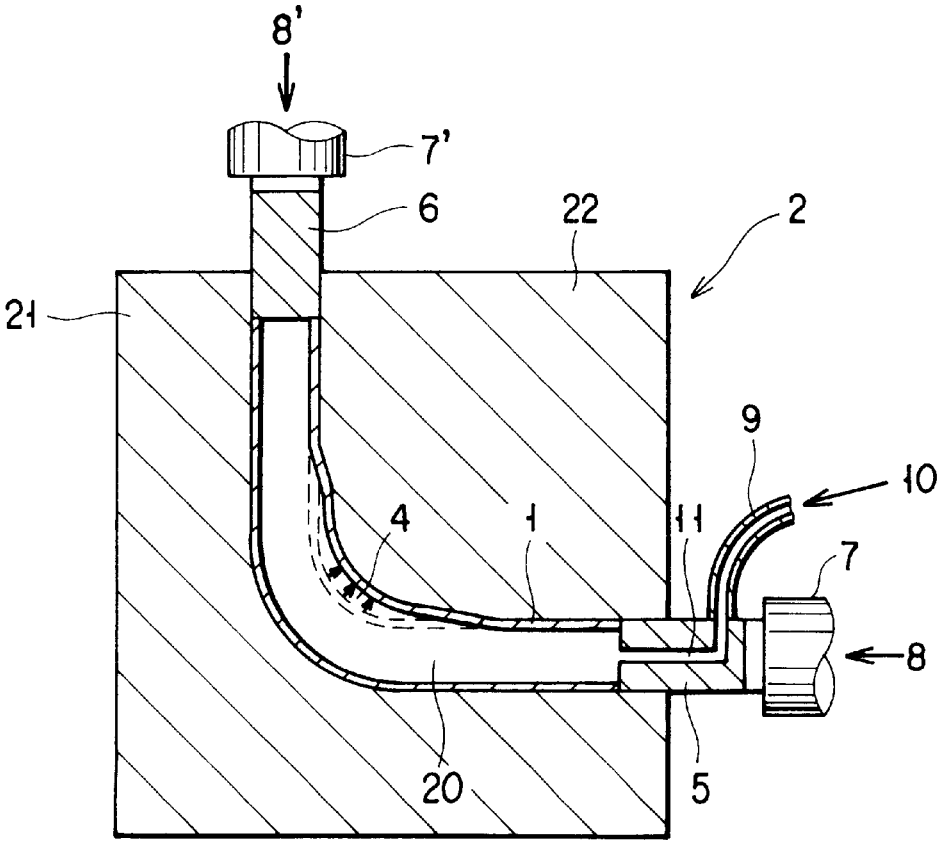
FIG. 1B is a horizontal sectional view of the apparatus.

Opposite sides of the bend pipe 1 are provided with pipe end pusher punches 5 and 6 which are used for closing both end portions of the bend pipe. Each of these punches 5 and 6 is connected with a cylinder so that a pushing load 8, 8' is applied to the respective ends of the bend pipe 1 in the cavity 20. In FIG. 1B, reference numerals 7 and 7' denote a cylinder head.

Also, the pipe end pusher punch 5 is formed with a pressure medium supply hole 11 which is connected with a pressure hose 9. A pressure medium, such as water or oil is supplied from a medium supply source (not shown) to an interior of the bend pipe 1 set in the cavity 20 through the pressure hose 9 and the pressure medium supply hole 11. Then, a hydraulic pressure 10 is applied to the bend pipe 1. As a result, the bend pipe 1 is subjected to bulge forming.

The cavity 20 is formed with a bulging region 4 at a portion corresponding to an inside portion on a bent portion of a bend pipe. Therefore, when a hydraulic pressure 10 is applied to the bend pipe 1, the bent portion on the inside of the bend pipe is bulged toward the region 4.

In the case where bulge forming is carried out with use of the apparatus as described above, the bend pipe 1 previously subjected to bending is set in the cavity 20 as a raw member, and is fixed by closing divisional type upper and lower dies 2 and 3. Subsequently, pressing punches 12 and 12' are fitted in these dies, and further, pipe end pushing punches are set therein.

In such a state, a pressure medium is supplied to the interior of the bend pipe 1 set in the cavity through the pressure hose 9 and the pressure medium supply hole 11, and an internal pressure is applied to the bend pipe 1, thus the bend pipe 1 being subjected to bulge forming.

Conventionally, pressing load 8, 8' is generally applied to pipe ends by means of punches 5 and 6 via cylinder head 7, 7' while applying an internal pressure to the pipe with use of pressure medium. In this manner, the material is supplied to a bulging portion. However, in the present embodiment, the cavity 20 is formed with a bulging region 4 at a portion corresponding to an inside on bent portion of a raw material. For this reason, a wall thickness of a bulging portion becomes thicker than that of the pipe in a straight state. Therefore, the present embodiment does not always need to push the pipe ends as described above. Specifically, the push against the pipe end may be carried out in a case where there is a possibility of breaking even if the wall thickness of the inside portion is increased. Even in such a case, an amount of material to be supplied may be a little. Therefore, indentation of punches 5 and 6 may be also a little.

Moreover, in the case where there is a need of pressing the pipe from the up-and-down directions to obtain a desired shape, an upsetting cylinder is actuated, and then, load 13, 13' is applied to the bend pipe 1 by means of punches 12 and 12', thus pressing being carried out. As described above, when pressing is carried out during bulge forming, an internal pressure rises up in pressing while bulge forming rapidly progressing, like conventional bulge forming of a straight pipe. For this reason, management of a circumferential length is required so that the material is not left over.

As described above, in this embodiment, the cavity 20 is formed with the bulging region 4 at a portion corresponding to an inside on a bent portion of a bend pipe, and only inside thicker portion is positively subjected to bulge forming. Therefore, this serves to avoid a disadvantage that a thin outside portion becomes thinner due to bulge forming.

Figure 2A:
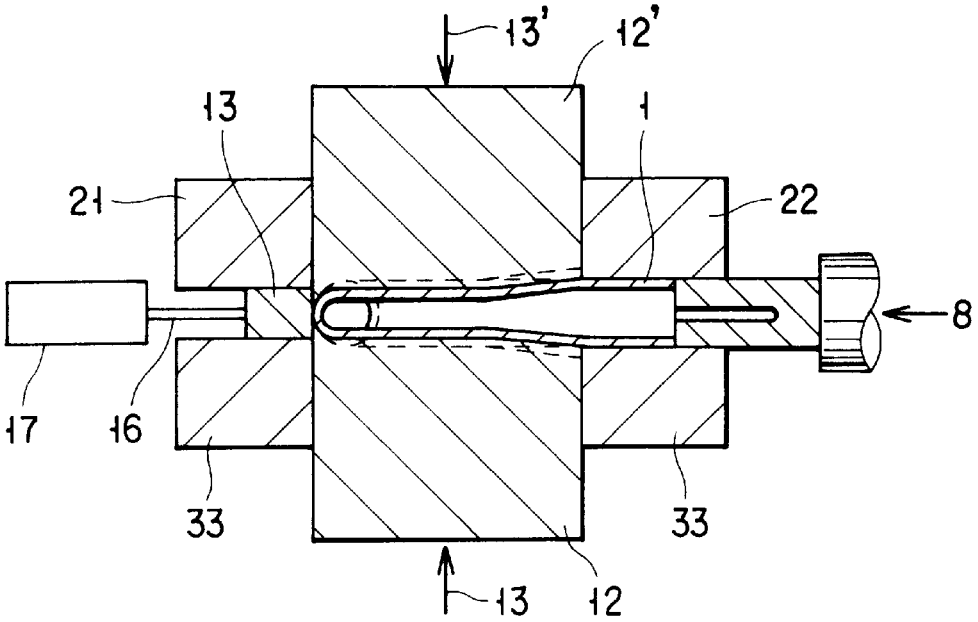
FIG. 2A is a vertical sectional view of an apparatus for carrying out a bulge forming method according to another embodiment of the present invention.
Figure 2B:
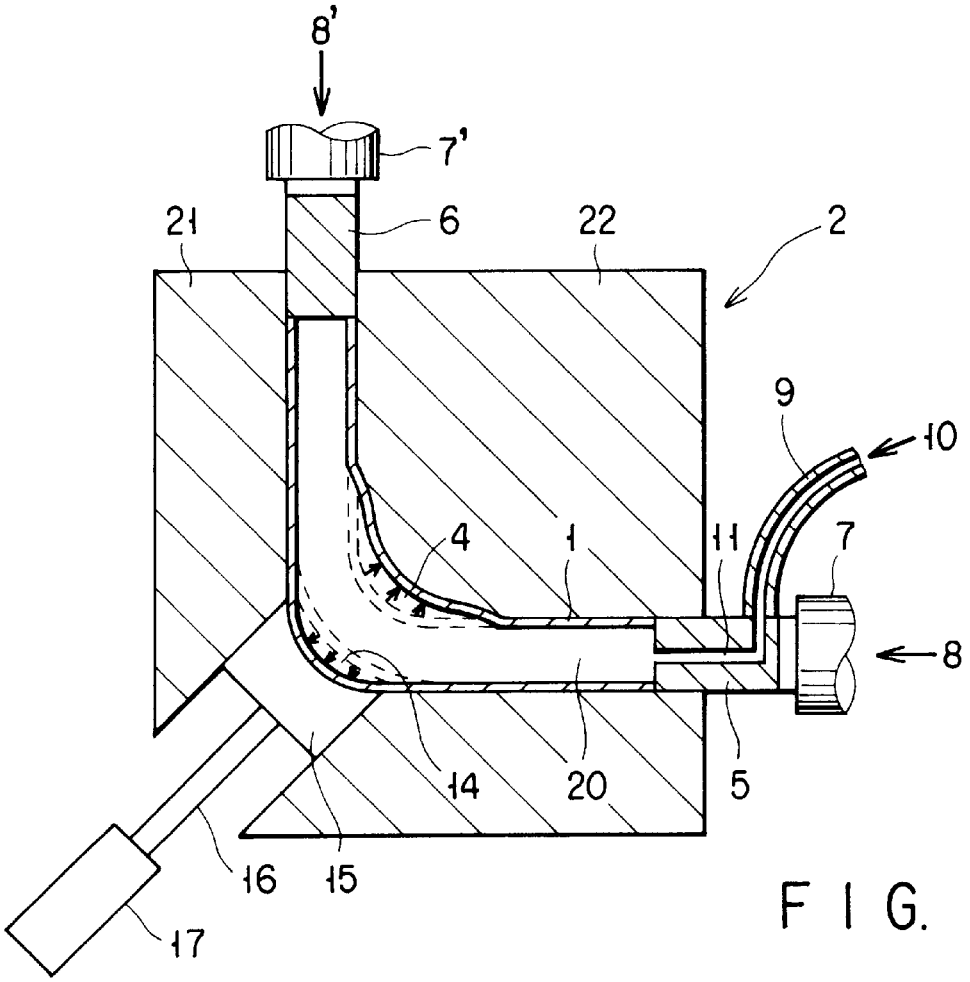
FIG. 2B is a horizontal sectional view of the apparatus.

The following is an explanation about another embodiment. This embodiment shows a case where there is a need of subjecting an outside portion of a bent portion of the bend pipe 1 to bulge forming. FIG. 2 shows an apparatus for carrying out a hydraulic bulge forming method according to this embodiment.

The apparatus has a configuration same as that of the apparatus shown in FIG. 1. Therefore, like reference numerals are used to designate the same components as those of FIG. 1.

This apparatus is provided with a support die 15 for supporting an outside portion on the bent portion of the bend pipe 1 which becomes thinnest in bending. The support die 15 is movable forward and backward by means of a cylinder 17 via a rod 16.

In the apparatus constructed as described above, the support die 15 is arranged so as to come into contact with the outside portion of the bent portion of the bend pipe 1, and is retreated by means of the cylinder 17 in accordance with the progress of bulge forming. In this case, the outside portion on the bent portion of the bend pipe is bulged toward a region 14 formed in the cavity by retreating the support die 15. However, the support die 15 is retreated in accordance with deformation of the bend pipe 1 caused by bulge forming in a state of supporting the outside on the bent portion of the bend pipe 1. Thus, forming can be carried out while suppressing the outside portion on the bent portion of the bend pipe 1 from being reduced in its wall thickness.

In this case, there are some ideas that the retreat timing or retreat speed of the support die 15 is obtained from experimentation, or is controlled on the basis of control equation as described in Japanese Patent Publication (Kokai) No. 7-155857. On the other hand, a load cell is located on the way of the rod 16 connecting the support die 15 and the cylinder 17, and a load detected by the load cell may be controlled so as to become constant. Such a method is also effective.

Preforming with respect to a raw member is not restricted to the aforesaid bending, but may combine with other tube forming such as flaring and varied thick-walled forming. Also, bending is not restricted to a typical bending which is a rotary draw bending, and may be various bending such as push bending and press bending. Further, The pressure medium is not restricted to a liquid such as water and oil, but a rubber applied for rubber bulging or particles or fine spheres applied for solid bulging may be employed.

Embodiments

The embodiments of the present invention will be described below.

Figure 3:
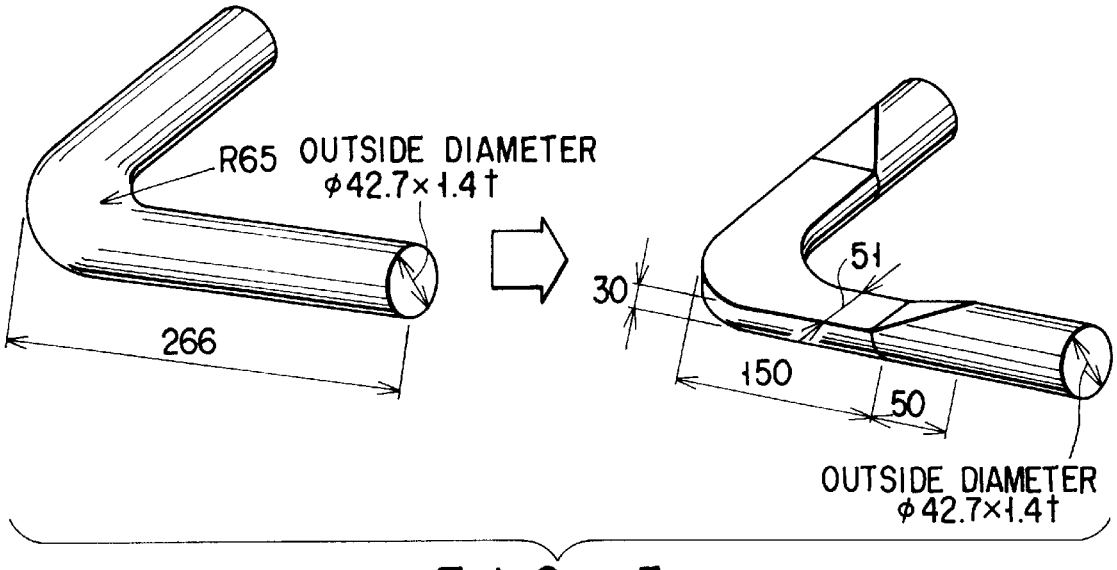
FIG. 3 is a view showing a pipe employed in embodiments and a forming process.

In order to clarify the difference between conventional forming methods and the present invention, the following experiment was made. An STKM13B pipe having ϕ 42.7× $1.4^t$ was used as a raw member. And then, the raw pipe member was subjected to rotary draw bending and was formed into a bend pipe as shown in the left-hand side on FIG. 3. Evaluation was made with respect to a circumferential length of the maximum bulging portion in order to compare the aforesaid bend pipe with bend pipes formed into a shape as shown in the right-hand side on FIG. 3 according to various forming methods. A silicon rubber was used as a pressure medium because it is relatively easy to generate an isotropic pressure.

In this embodiment, a bend pipe was formed according to the following four methods.

(1) Simple upset forming method (Prior Art)

Figure 4:
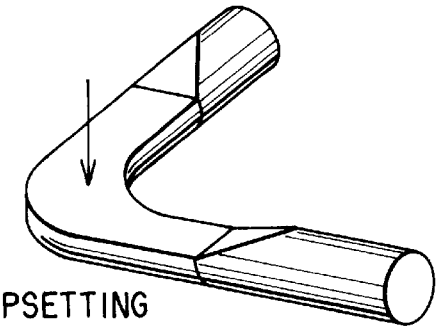
FIG. 4 PRIOR ART
FIG. 4 is a view showing a simple upsetting method in the prior art.

According to this method, as seen from FIG. 4, in order to prevent buckling from being caused in the inward of the pipe, upset forming was carried out while a internal pressure being slightly applied without pushing the pipe ends. Bulge forming was not positively carried out. For this reason, the periphery of the upset potion was not pressed by means of dies.

(2) Outside bulge forming method (Prior Art)

Figure 5:
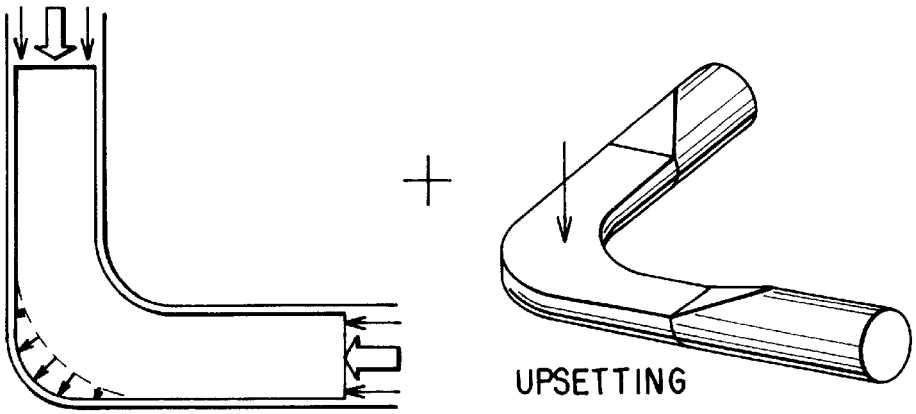
FIG. 5 PRIOR ART
FIG. 5 is a view showing an outside bulge forming method in the prior art.

This method is the most general as prior art. As shown in the left-hand side of FIG. 5, a cavity was formed at a portion corresponding to the outside on the bent portion of the bend pipe, and the pipe ends were pushed while an internal pressure being applied. And then, the bend pipe was subjected to upsetting from up-and-down directions, as shown in the right-hand side of FIG. 5.

(3) Inside bulge forming method (present Invention)

As described in FIG. 1, bulge forming was not carried out with respect to the outside on the bent portion of the bend pipe, and bulge forming was carried out so that the bent portion of the bend pipe is bulged toward the inside. At this time, an internal pressure was applied, and the pipe ends was slightly pushed, and further, vertical upsetting was carried out.

(4) Inside bulge forming and use of a movable support die (present Invention)

As described in FIG. 2, the inside of the bent portion of the bend pipe was bulged while subjecting the outside portion on the bent portion of the bend pipe with use of the movable support die.

Figure 6:
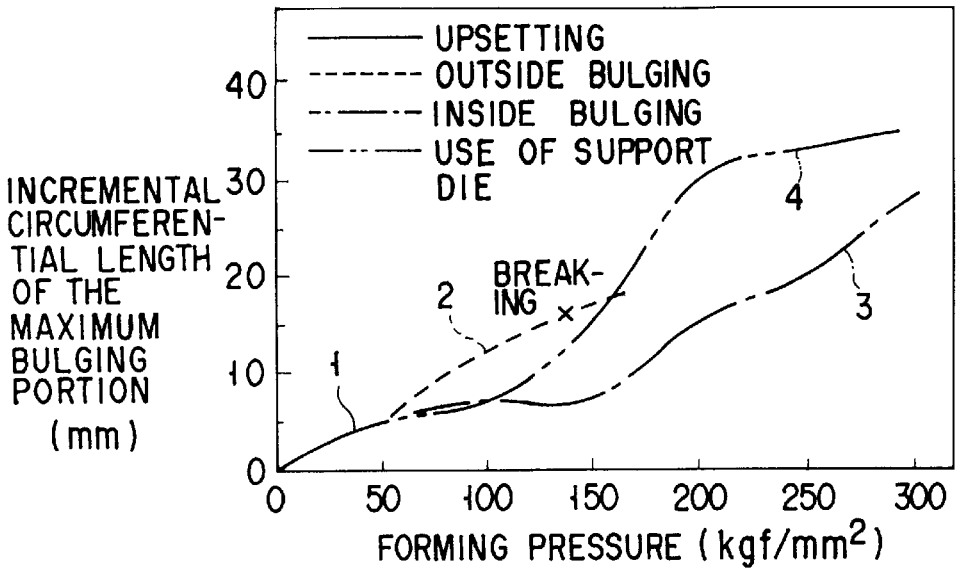
FIG. 6 is a graph showing a relationship between a forming pressure and an increase in a circumferential length of a maximum bulging portion in various forming methods.

Each bend pipe formed according to the aforesaid forming methods was extracted as sample, and then, an incremental circumferential length of the maximum bulging portion of each sample was measured. The results was as shown in Table 1. Further, a relationship between forming pressure and the circumferential length of the maximum bulging portion was shown in FIG. 6.

TABLE 1

| Forming Method | Classification | Incremental circumferential length of the maximum bulging portion (mm) | Remark |
|---|---|---|---|
| (1) Simple upsetting | Prior Art | 2 mm | no change in circumferential length |
| (2) Outside bulging | Prior Art | 17 mm | breaking is caused in the outside portion of bent portion |
| (3) Inside bulging | This invention | 28 mm | bulgy in a predetermined cavity |
| (4) Inside bulging + movable support die | This invention | 35 mm | bulgy in a predetermined cavity |

As seen from the above Table 1, according to the simple upset forming method (1), in order to prevent buckling from being caused, a little pressure was only applied to the interior of the bend pipe. For this reason, the forming pressure did not so rise. Therefore, almost no bulging deformation was caused. Moreover, according to the outside bulge forming method (2), forming pressure raised while bulging deformation being progressed. However, the wall thickness of the outside portion on the bent portion of the bend pipe became thin. For this reason, breaking was caused in the outside portion at the point of time it exceeded the elongation limit of the raw pipe member. Therefore, it was impossible to form the pipe into a predetermined shape.

In contrast to these forming methods in prior art, according to the inside bulge forming (3) of this invention, the outside on the bent portion of the bend pipe which is a portion having a danger of causing breaking was not deformed, and an inside portion which became thicker in bending was bulged. Thus, it was possible to form the bend pipe into a predetermined shape without causing breaking. This is evident from the following experimental results. Specifically, according to the outside bulging method in the prior art, the incremental circumferential length of the maximum bulging portion was slightly 17 mm; nevertheless breaking was caused therein. On the contrary, according to the inside bulge forming method, the incremental circumferential length of the maximum bulging portion was 28 mm; nevertheless breaking was not caused therein. Moreover, according to the method (4) with use of movable support die in order to bulge the outside on the bent portion which is a portion having a danger of causing breaking, the circumferential length incremented up to 35 mm because incremental circumferential length of the outside portion was added.

Figure 7:
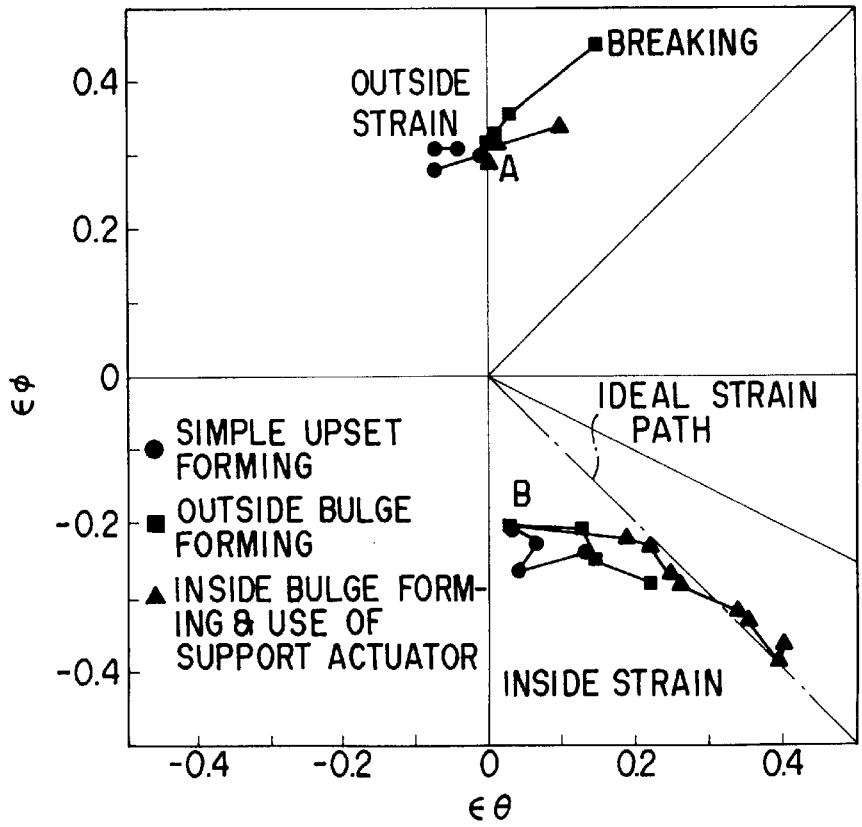
FIG. 7 is a graph showing a strain history on an outside of a bent portion and on an inside of a bent portion in various forming methods.
Figure 8:
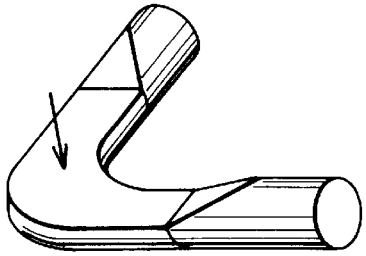
FIG. 8 is a view showing an example of a bulging product obtained by subjecting a bend pipe to bulge forming.
Figure 9:
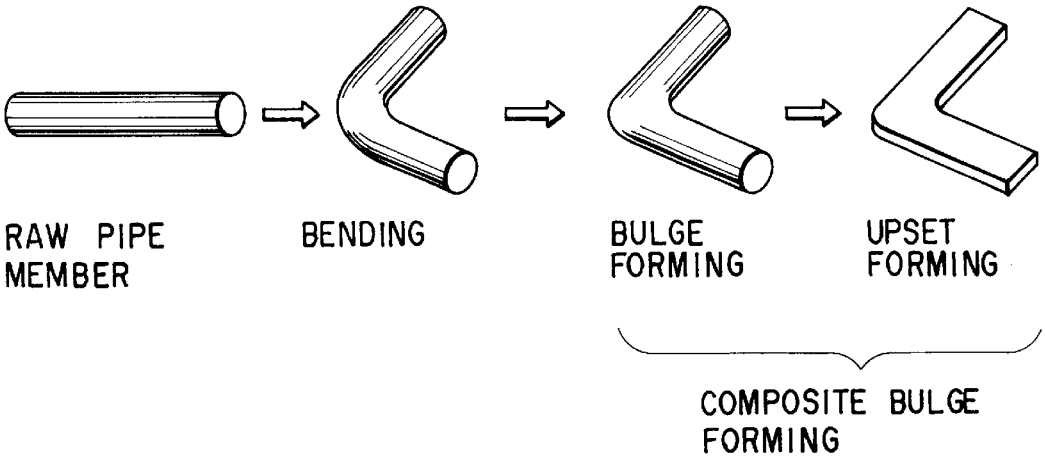
FIG. 9 PRIOR ART
FIG. 9 is a view showing a conventionally typical forming process for the bulging product shown in FIG. 8.
Figure 10:
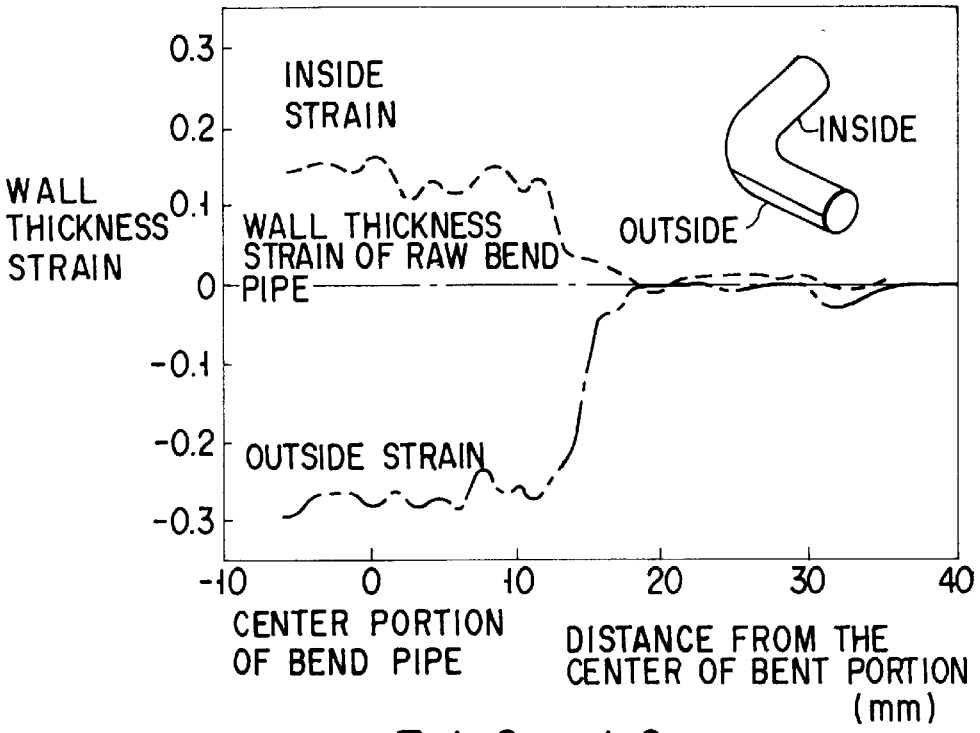
FIG. 10 is a graph showing a thickness strain distribution in a longitudinal direction after a straight pipe is subjected to rotary draw bending.
Figure 11:
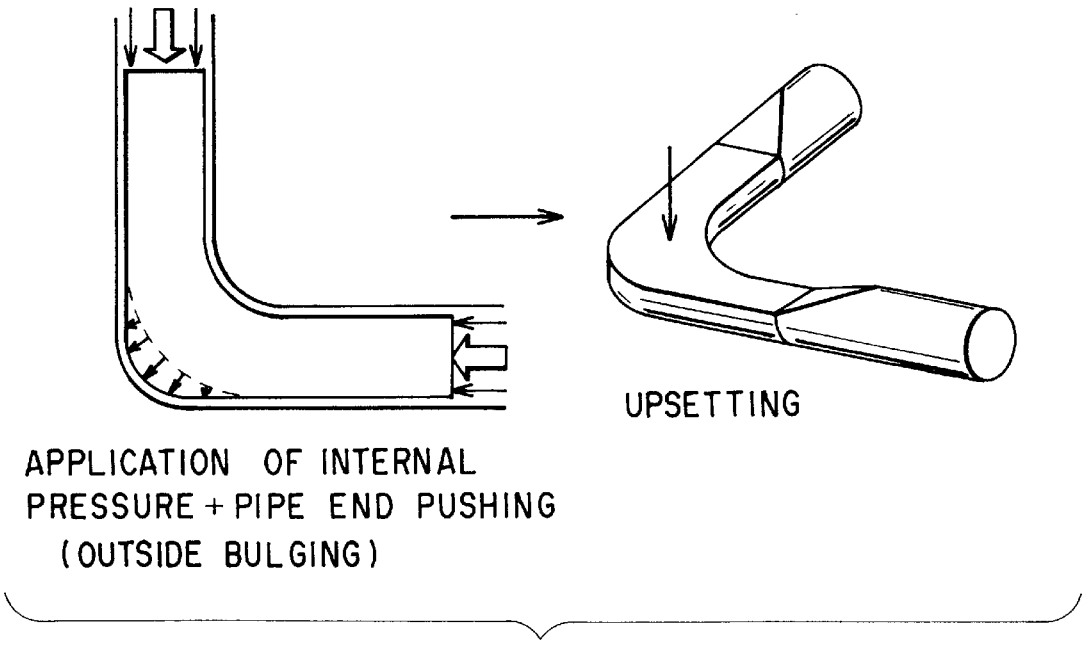
FIG. 11 is a view showing a composite bulge forming method.

This fact could be grasped from strain in circumferential and longitudinal directions of the bend pipe. In FIG. 7, there was shown results measured strain history on outside and inside portions on the bent portion of the bend pipe. Specifically, the strain history was measured in the following manner of sintering a scribed circle on the outer surface of a pipe in a state of being straight, and stopping the bend pipe forming by aforesaid methods, thus reading a circle diameter. In FIG. 7, one dotted chain line is indicative of an ideal state in bulge deformation, and shows that when a circumferential strain $\epsilon\ \theta$ has a constant elongation, a longitudinal strain $\epsilon\ \phi$ is shrunken by the same length. Namely, based on volume constancy low, it means that a wall thickness strain remains unchanged. Therefore, there is no reduction in a wall thickness which is a factor of breaking.

In the present embodiment, bending is previously carried out. As seen from FIG. 7, the outside of the bent portion of the bend pipe has no circumferential strain. However, longitudinal strain increments, and also, the wall thickness is reduced. On the other hand, the inside of the bent portion of the bend pipe has no circumferential strain. However, the longitudinal strain becomes compressive strain. For this reason, the wall thickness is incremented. Thus, respective composite bulge forming of outside and inside of the bent portion of the bend pipe starts from at a point A and from a point B shown in FIG. 7.

In the simple upset forming method, there is caused almost no bulging deformation as described above. Therefore, strain on outside and inside portions remains unchanged. On the other hand, in the outside bulging method, the circumferential strain on the outside increments by bulge forming and elongation is caused in the longitudinal direction. A so-called balanced biaxial bulge deformation takes place, and as a result, breaking is caused.

On the contrary, the present invention employs the inside bulge forming with use of movable support die. Thus, a main region where deformation takes place is an inside on the bent portion of the bend pipe. When bulge deformation starts, in the initial stage of deformation, circumferential strain only increments from the point B of FIG. 7. Subsequently, when the deformation advances and strain reaches the ideal strain path, compressive strain is caused by a geometric shape of the inside R and by pipe end pushing effect, whereby ideal strain history can be obtained without reducing or increasing a wall thickness. Off course, the strain increments because the outside on the bent portion of the bend pipe is subjected to bulge forming. But, the strain is less than that of the conventional methods because the movable support die is used in the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A bulge forming method comprising:

inserting a bend pipe into a cavity formed in a die, said bend pipe having a bent portion that possesses an inside and an outside, the inside of the bent portion having a smaller radius than the outside of the bent portion, said cavity being formed with a bulging region at a portion corresponding to the inside on the bent portion of said bend pipe, said bulging region extending over less than the entire circumferential extent of the portion of the cavity corresponding to the inside of the bent portion of the bend pipe; and supplying a pressure medium into an interior of said bend pipe to plastically deform said bend pipe so that said inside on the bent portion is bulged along said bulging region.

2. The method according to claim 1, further including pushing ends of said bend pipe during the supplying step.

3. The method according to claim 1, further including pressing said bend pipe during the supplying step.

4. A bulge forming method comprising:

inserting a bend pipe into a cavity formed in a die, the bend pipe having a bent portion that possesses an inside and an outside, the inside of the bent portion having a smaller radius than the outside of the bent portion;

arranging a movable support die for supporting the outside on the bent portion of the bend pipe inserted in said cavity; and supplying a pressure medium to an interior of said bend pipe to plastically deform the outside, and moving said support die to support the outside in accordance with the deformation of the outside of the bent portion.

5. The method according to claim 4, further including pushing ends of said bend pipe during said supplying step.

6. The method according to claim 4, further including pressing said bend pipe during said supplying step.

7. A bulge forming method comprising:

inserting a bend pipe into a cavity formed in a die, said bend pipe including a bent portion having an inside and an outside, the inside of the bent portion possessing a smaller radius than the outside of the bent portion, said cavity being formed with a bulging region at a portion corresponding to an inside on a bent portion of said bend pipe;

arranging a movable support die for supporting the outside on the bent portion of the bend pipe inserted in said cavity;

supplying a pressure medium to an interior of said bend pipe to plastically deform said bend pipe so that the inside on the bent portion is bulged along said bulging region; and plastically deforming the outside by supplying the pressure medium, and moving said support die to support the outside of the bent portion in accordance with the deformation of the bend pipe.

8. A bulge forming apparatus comprising:

a die having a cavity adapted to receive a bend pipe, the bend pipe including a bent portion having an inside and an outside, the inside of the bent portion possessing a smaller radius than the outside of the bent portion, said cavity being formed with a bulging region at a portion corresponding to the inside of the bent portion of said bend pipe when the bend pipe is positioned in the cavity, said bulging region extending over less than the entire circumferential extent of the portion of the cavity corresponding to the inside of the bent portion of the bend pipe; and means for supplying a pressure medium to an interior of said bend pipe inserted in said cavity to plastically deform said bend pipe so that the inside of the bend portion is bulged along said bulging region while a pressure is applied to said bend pipe.

9. The apparatus according to claim 8, further including means for pushing ends of said bend pipe.

10. The apparatus according to claim 8, further including:

a pipe end closing member arranged on both ends of said bend pipe, said pipe end closing member having a hole for connecting the interior of said bend pipe to the exterior;

means for pushing pipe ends of said bend pipe into said die via said pipe end closing member; and means for supplying a pressure medium into said bend pipe through said hole.

11. The apparatus according to claim 8, wherein said die further includes means for pressing said bend pipe inserted in said cavity.

12. A bulge forming apparatus comprising:

a die having a cavity for receiving a bend pipe, the bend pipe including a bent portion having an inside and an outside, the inside of the bent portion possessing a smaller radius than the outside of the bent portion;

means for supplying a pressure medium to an interior of said bend pipe inserted in said cavity;

a movable support die for supporting the outside on the bent portion of said bend pipe; and actuator means for moving said movable support die so that said support die supports the outside of the bent portion in accordance with the deformation of the outside of the bent portion by said pressure medium.

13. The apparatus according to claim 12, further including means for pushing ends of said bend pipe.

14. The apparatus according to claim 12, further including:

a pipe end closing member arranged on both ends of said bend pipe, said closing member having a hole for connecting an interior of said bend pipe to the exterior;

means for pushing pipe ends of said bend pipe into said die via said pipe end closing member; and means for supplying a pressure medium into said bend pipe through said hole.

15. The apparatus according to claim 12, wherein said die further includes means for pressing said bend pipe inserted in said cavity.

16. A bulge forming apparatus comprising:

a die having a cavity capable of receiving a bend pipe therein, said bend pipe including a bent portion having an inside and an outside, the inside of the bent portion having a smaller radius than the outside of the bent portion, said cavity being formed with a bulging region at a portion corresponding to the inside of the bent portion of said bend pipe when the bend pipe is inserted into the cavity;

means for supplying a pressure medium to an interior of said bend pipe inserted in said cavity to plastically deform said bend pipe so that said inside of the bend portion is bulged in said bulging region while a pressure is applied to said bend pipe;

a movable support die for supporting the outside on the bent portion of said bend pipe; and actuator means for moving said movable support die so that said support die supports the outside of the bent portion in accordance with the deformation of the outside by said pressure medium.

* * * * *